US008126687B2

(12) United States Patent
Matsunaga et al.

(10) Patent No.: US 8,126,687 B2
(45) Date of Patent: Feb. 28, 2012

(54) METHOD OF IDENTIFYING AN ANTINODE OF A PRIMARY VIBRATION MODE OF A GOLF CLUB HEAD

(75) Inventors: Hideo Matsunaga, Saitama (JP); Wataru Ban, Saitama (JP); Hideo Shimazaki, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 12/417,693

(22) Filed: Apr. 3, 2009

(65) Prior Publication Data

US 2009/0240479 A1 Sep. 24, 2009

Related U.S. Application Data

(62) Division of application No. 11/435,989, filed on May 18, 2006, now abandoned.

(30) Foreign Application Priority Data

Dec. 26, 2005 (JP) ..... 2005-373457

(51) Int. Cl.
*G06G 7/48* (2006.01)
*A63B 53/04* (2006.01)

(52) U.S. Cl. ..... 703/6; 473/324

(58) Field of Classification Search ..... 473/324–350; 703/6

See application file for complete search history.

(56) References Cited

U.S. PATENT DOCUMENTS

| | | | | |
|---|---|---|---|---|
| 2,846,228 | A | 8/1958 | Reach | |
| 3,084,940 | A | 4/1963 | Cissel | |
| 4,804,188 | A | 2/1989 | McKee et al. | |
| 4,811,950 | A | 3/1989 | Kobayashi | |
| 4,928,972 | A | 5/1990 | Nakanishi et al. | |
| 5,290,036 | A | 3/1994 | Fenton et al. | |
| 5,299,807 | A | 4/1994 | Hutin | |
| 5,316,298 | A | 5/1994 | Hutin et al. | |
| 5,316,305 | A | 5/1994 | McCabe | |
| 5,351,958 | A | 10/1994 | Helmstetter | |
| 5,362,055 | A | 11/1994 | Rennie | |
| 5,409,229 | A | 4/1995 | Schmidt et al. | |
| 5,411,255 | A * | 5/1995 | Kurashima et al. | 473/332 |
| 5,431,396 | A | 7/1995 | Shieh | |

(Continued)

FOREIGN PATENT DOCUMENTS

EP 1757334 A1 2/2007

(Continued)

OTHER PUBLICATIONS

Japanese Office Action corresponding to Japanese Patent Application No. 2005-373457 dated Dec. 10, 2010.

*Primary Examiner* — Alvin Hunter
(74) *Attorney, Agent, or Firm* — Sughrue Mion, PLLC

(57) ABSTRACT

This invention provides a method of identifying an antinode of a primary vibration mode of the golf club head having a hollow golf club head having a face portion, a crown portion, a sole portion, and a side portion. A viscoelastic body is to be mounted in at least one of the face portion, crown portion, sole portion, and side portion. The viscoelastic body is mounted in a part of a portion where the viscoelastic body is to be mounted, the part corresponding to an antinode of a primary vibration mode.

2 Claims, 3 Drawing Sheets

U.S. PATENT DOCUMENTS

| | | | | |
|---|---|---|---|---|
| 5,492,327 | A | 2/1996 | Biafore, Jr. | |
| 5,529,543 | A | 6/1996 | Beaumont, Sr. | |
| 5,564,705 | A | 10/1996 | Kobayashi et al. | |
| 5,586,947 | A | 12/1996 | Hutin | |
| 5,643,111 | A | 7/1997 | Igarashi | |
| 5,692,972 | A | 12/1997 | Langslet | |
| 5,697,855 | A | 12/1997 | Aizawa | |
| 5,703,294 | A | 12/1997 | McConnell et al. | |
| 5,766,092 | A | 6/1998 | Mimeur et al. | |
| 5,766,093 | A | 6/1998 | Rohrer | |
| 6,045,456 | A | 4/2000 | Best et al. | |
| 6,093,116 | A | 7/2000 | Hettinger et al. | |
| 6,265,475 | B1 | 7/2001 | Chifei et al. | |
| 6,302,807 | B1 | 10/2001 | Rohrer | |
| 6,431,997 | B1 | 8/2002 | Rohrer | |
| 6,454,664 | B1 * | 9/2002 | Long et al. | 473/330 |
| 6,616,546 | B2 | 9/2003 | Cho | |
| 6,642,308 | B2 | 11/2003 | Nomura et al. | |
| 6,672,975 | B1 | 1/2004 | Galloway | |
| 6,688,989 | B2 | 2/2004 | Best | |
| 6,743,114 | B2 | 6/2004 | Best | |
| 6,743,117 | B2 | 6/2004 | Gilbert | |
| 6,773,360 | B2 | 8/2004 | Willett et al. | |
| 6,780,123 | B2 | 8/2004 | Hasebe | |
| 6,835,144 | B2 | 12/2004 | Best | |
| 6,855,066 | B2 | 2/2005 | Best | |
| 6,876,956 | B1 * | 4/2005 | Cirak et al. | 703/2 |
| 6,902,495 | B2 | 6/2005 | Pergande et al. | |
| 6,984,180 | B2 | 1/2006 | Hasebe | |
| 6,991,559 | B2 | 1/2006 | Yabu | |
| 6,991,560 | B2 | 1/2006 | Tseng | |
| 7,048,647 | B2 | 5/2006 | Burrows | |
| 7,108,613 | B1 | 9/2006 | Gordon et al. | |
| 7,119,146 | B2 | 10/2006 | Tse et al. | |
| 7,182,698 | B2 | 2/2007 | Tseng | |
| 7,189,169 | B2 | 3/2007 | Billings | |
| 7,207,899 | B2 | 4/2007 | Imamoto | |
| 7,226,366 | B2 | 6/2007 | Galloway | |
| 7,303,485 | B2 | 12/2007 | Tseng | |
| 7,303,486 | B2 | 12/2007 | Imamoto | |
| 7,316,623 | B2 | 1/2008 | Imamoto | |
| 7,371,190 | B2 | 5/2008 | Gilbert et al. | |
| 7,430,499 | B2 * | 9/2008 | Rassaian et al. | 703/2 |
| 2003/0027662 | A1 | 2/2003 | Werner et al. | |
| 2003/0092502 | A1 | 5/2003 | Pergande et al. | |
| 2004/0043830 | A1 | 3/2004 | Imamoto | |
| 2004/0053704 | A1 | 3/2004 | Gilbert | |
| 2004/0242339 | A1 | 12/2004 | Gilbert et al. | |
| 2005/0124437 | A1 | 6/2005 | Imamoto | |
| 2005/0148405 | A1 | 7/2005 | Imamoto | |
| 2005/0192116 | A1 | 9/2005 | Imamoto | |
| 2005/0192118 | A1 | 9/2005 | Imamoto | |
| 2005/0197208 | A1 | 9/2005 | Imamoto | |
| 2006/0258480 | A1 | 11/2006 | Hou et al. | |
| 2007/0049400 | A1 | 3/2007 | Imamoto et al. | |
| 2007/0129160 | A1 | 6/2007 | Matsunaga et al. | |
| 2007/0129161 | A1 | 6/2007 | Matsunaga et al. | |
| 2007/0129162 | A1 | 6/2007 | Pan et al. | |
| 2007/0129164 | A1 | 6/2007 | Shimazaki et al. | |
| 2007/0129165 | A1 | 6/2007 | Matsunaga et al. | |
| 2007/0129166 | A1 | 6/2007 | Shimazaki et al. | |
| 2007/0129168 | A1 | 6/2007 | Matsunaga et al. | |
| 2007/0149313 | A1 | 6/2007 | Matsunaga et al. | |
| 2008/0020860 | A1 | 1/2008 | Imamoto | |

FOREIGN PATENT DOCUMENTS

| | | | |
|---|---|---|---|
| FR | 2717701 | A1 | 9/1995 |
| JP | 01166779 | A | 6/1989 |
| JP | 2141475 | U | 11/1990 |
| JP | 3049776 | A | 3/1991 |
| JP | 05028361 | U | 4/1993 |
| JP | 05147096 | A | 6/1993 |
| JP | 06007486 | A | 1/1994 |
| JP | 06510689 | A | 6/1994 |
| JP | 06254183 | A | 9/1994 |
| JP | 06319836 | A | 11/1994 |
| JP | 0727630 | U | 5/1995 |
| JP | 07148291 | A | 6/1995 |
| JP | 07213656 | A | 8/1995 |
| JP | 06206258 | A | 8/1996 |
| JP | 08206258 | A | 8/1996 |
| JP | 09000666 | A | 1/1997 |
| JP | 09122281 | A | 5/1997 |
| JP | 11114112 | A | 4/1999 |
| JP | 11333029 | A | 12/1999 |
| JP | 2000116824 | A | 4/2000 |
| JP | 2000197718 | A | 7/2000 |
| JP | 2001000606 | A | 1/2001 |
| JP | 2001170225 | A | 6/2001 |
| JP | 2004313777 | A | 11/2001 |
| JP | 2003093550 | A | 4/2003 |
| JP | 2003102877 | A | 4/2003 |
| JP | 2003250939 | A | 9/2003 |
| JP | 2003260153 | A | 9/2003 |
| JP | 2003265652 | A | 9/2003 |
| JP | 2003265653 | A | 9/2003 |
| JP | 2004089434 | A | 3/2004 |
| JP | 2005006763 | A | 1/2005 |
| JP | 3112038 | U | 6/2005 |
| JP | 2005143589 | A | 6/2005 |
| JP | 2005160947 | A | 6/2005 |
| JP | 2005160948 | A | 6/2005 |
| JP | 2005218510 | A | 8/2005 |
| JP | 2005245519 | A | 9/2005 |
| JP | 2006000139 | A | 1/2006 |
| JP | 2006000435 | A | 1/2006 |
| WO | 9920358 | A1 | 4/1999 |

* cited by examiner

METHOD OF IDENTIFYING AN ANTINODE OF A PRIMARY VIBRATION MODE OF A GOLF CLUB HEAD

This is a divisional of U.S. application Ser. No. 11/435,989, filed May 18, 2006, which claims priority to Japanese Application No. 2005-373457, filed Dec. 26, 2005 in the Japanese Patent Office, respectively. The entire disclosures are hereby incorporated by reference.

FIELD OF THE INVENTION

The present invention relates to a golf club head and, more particularly, to a technique for controlling vibration of a golf club head by a viscoelastic body.

BACKGROUND OF THE INVENTION

A technique for controlling vibration of a golf club head has been developed to improve the hitting impression or adjust the hitting sound on impact. Japanese Patent Laid-Open No. 2004-313777 discloses a golf club head having a viscoelastic body. When the viscoelastic body is attached, the vibration on impact is absorbed by the viscoelastic body to improve the hitting impression and decrease the hitting sound that is offensive to the player's ear. Japanese Patent Laid-Open No. 2005-6763 discloses analyzing the vibration mode of a golf club head by a computer to correct the thickness and the like of the materials that form the golf club head. Japanese Patent Laid-Open No. 2003-102877 discloses providing a metal rib to a part corresponding to the antinode of the secondary bending vibration of a golf club head.

As such a method of controlling the vibration of a golf club head, the simplest is a method of mounting a viscoelastic body in a golf club head, as in Japanese Patent Laid-Open No. 2004-313777. Conventionally, the viscoelastic body may be mounted on the rear surface of the face portion because this is where the impact is input, or on the sole portion in order to lower the barycenter of the golf club. Not many studies have been made, however, on that portion to mount the viscoelastic body which is effective in vibration suppression. Therefore, the viscoelastic body may not exhibit its vibration suppressing function effectively.

SUMMARY OF THE INVENTION

The present invention has been made in order to overcome the deficits of prior art.

According to the aspects of the present invention, there is provided a hollow golf club head having a face portion, a crown portion, a sole portion, and a side portion, the head comprising a viscoelastic body to be mounted in at least one of the face portion, the crown portion, the sole portion, and the side portion, wherein the viscoelastic body is mounted in a part of a portion where the viscoelastic body is to be mounted, the part corresponding to a antinode of a primary vibration mode.

According to the hollow golf club head, the viscoelastic body is mounted in the part of the portion where the viscoelastic body is to be mounted, the part corresponding to the antinode of the primary vibration mode. The part corresponding to the antinode of the primary vibration mode is where the magnitude of the vibration becomes the largest. Therefore, when the viscoelastic body is mounted in this portion, the vibration of the golf club head can be suppressed more effectively.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1A:
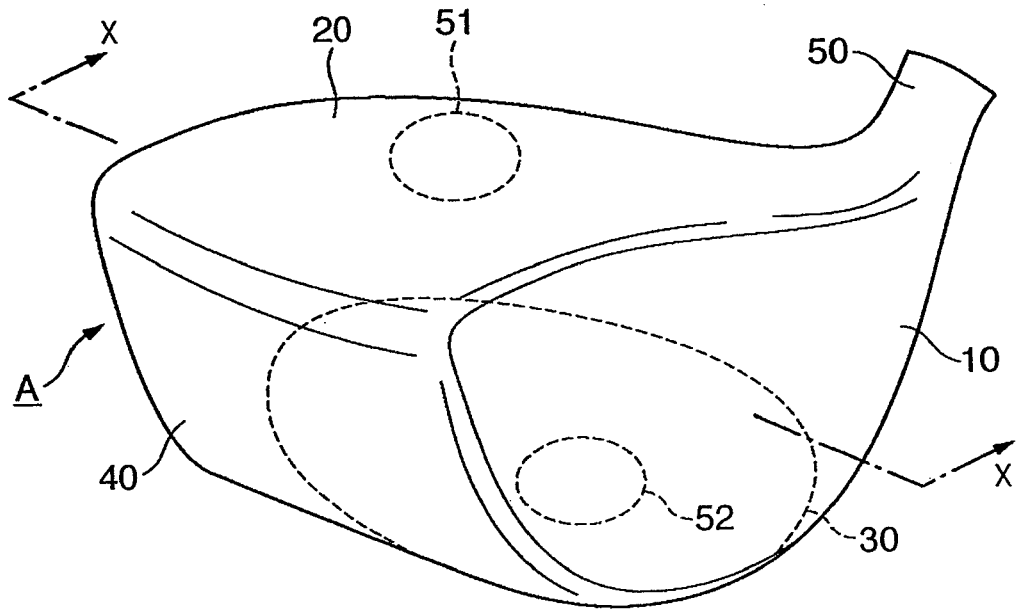
FIG. 1A is a view showing the outer appearance of a golf club head A according to an embodiment of the present invention.
Figure 1B:
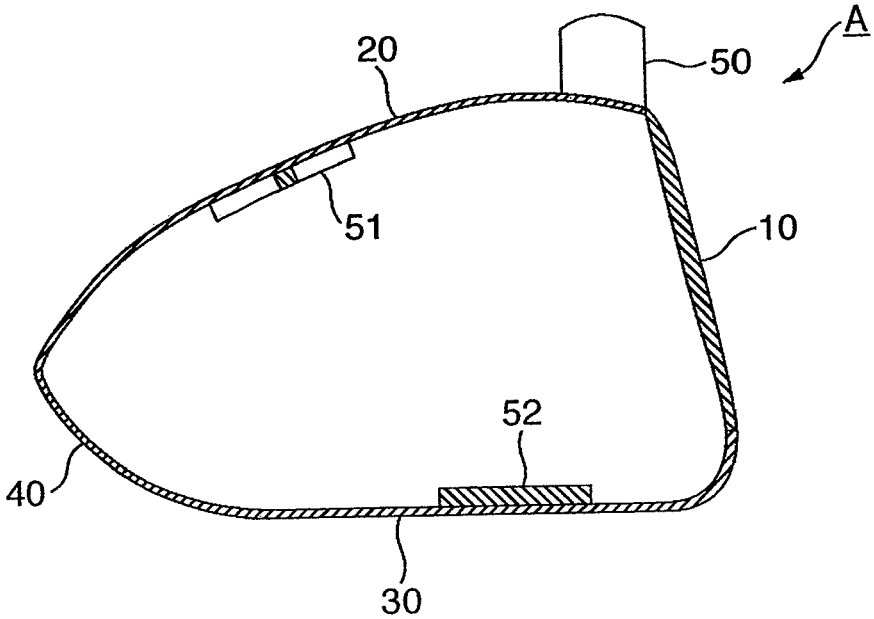
FIG. 1B is a sectional view of the golf club head A taken along the line X-X of FIG. 1A.

FIG. 1A is a view showing the outer appearance of a golf club head A according to an embodiment of the present invention, and FIG. 1B is a sectional view of the golf club head A taken along the line X-X (extending through substantially the center in the toe-to-heel direction) of FIG. 1A. The golf club head A forms a hollow body, and its circumferential wall constitutes a face portion 10 which forms a golf ball hitting surface, a crown portion 20 which forms the upper surface of the golf club head A, a sole portion 30 which forms the bottom surface of the golf club head A, and a side portion 40 which forms the toe-side, heel-side, and back-side side surfaces of the golf club head A. The golf club head A also has a hosel portion 50 to which a shaft is to be attached.

The golf club head A can be made of, e.g., a titanium-based metal material. Various types of manufacturing methods can be employed to make the golf club head A to have a hollow structure. For example, the crown portion 20, sole portion 30, side portion 40, and hosel portion 50 may be formed integrally, and a face member which forms the face portion 10 may be fixed to the resultant integrally formed component, thus forming a hollow structure. Alternatively, the face portion 10, crown portion 20, side portion 40, and hosel portion 50 may be formed integrally, and a sole member which forms the sole portion 30 may be fixed to the resultant integrally formed component, thus forming a hollow structure.

Although the golf club head A is a golf club head that is to be used as a driver, the present invention can be applied to a wood type golf club head including a fairway wood or the like other than the driver as well, a utility type golf club head, and other hollow golf club heads.

Viscoelastic bodies 51 and 52 are mounted in the crown portion 20 and sole portion 30, respectively, of the golf club head A. Examples of viscoelastic materials that form the viscoelastic bodies 51 and 52 include IIR (butyl bromide composition), NBR (acrylonitrile-butadiene rubber), natural rubber, silicone rubber, styrene-based rubber, and the like. The viscoelastic bodies 51 and 52 can also be formed by mixing a metal powder or the like in the viscoelastic materials described above to adjust their specific gravities. Preferably, the viscoelastic bodies 51 and 52 are made of viscoelastic materials with loss coefficients (so-called tan δ) the peak values of which are 0.3 or more. If the loss coefficients are 0.3 or more, a higher vibration attenuating effect can be obtained. The viscoelastic bodies 51 and 52 may be mounted on the circumferential wall of the golf club head A by, e.g., fixing with an adhesive or fixing with screws.

In this embodiment, the viscoelastic body 51 is mounted in a part of the crown portion 20 where the viscoelastic body 51 is to be mounted, the part corresponding to the antinode of the primary vibration mode. Similarly, the viscoelastic body 52 is mounted in a part of the sole portion 30 where the viscoelastic body 52 is to be mounted, the part corresponding to the antinode of the primary vibration mode. The part corresponding to the antinode of the primary vibration mode is where the magnitude of the vibration becomes the largest. Therefore, when the viscoelastic body is mounted in this portion, the vibration of the golf club head can be suppressed more effectively. More specifically, the viscoelastic body 51 suppresses the vibration of the crown portion 20 effectively. The viscoelastic body 52 suppresses the vibration of the sole portion 30 effectively. According to this embodiment, the vibration of the golf club head A is suppressed effectively at the respective unitary portions of the golf club head A separately in this manner, so that the vibration of the golf club head A as a whole is suppressed effectively.

According to this embodiment, the viscoelastic bodies 51 and 52 are mounted in the two portions (crown portion 20 and sole portion 30) of the face portion 10, crown portion 20, sole portion 30, and side portion 40. However, a viscoelastic body can be mounted in any one of the four portions 10 to 40 described above. Alternatively, viscoelastic bodies can naturally be mounted in three or more portions of the four portions 10 to 40 described above. If viscoelastic bodies are mounted in a plurality of portions of the four portions 10 to 40 descried above, the vibration suppressing effect of the golf club head A as a whole enhances accordingly.

Whichever portion the viscoelastic body may be mounted, it is mounted in the part of the portion where the viscoelastic body is to be mounted, the part corresponding to the antinode of the primary vibration mode. More specifically, when the viscoelastic body is to be mounted in the face portion 10, it is mounted in the part of the face portion, which corresponds to the antinode of the primary vibration mode. When the viscoelastic body is to be mounted in the crown portion 20, it is mounted in the part of the crown portion 20, which corresponds to the antinode of the primary vibration mode. When the viscoelastic body is to be mounted in the sole portion 30, it is mounted in the part of the sole portion 30, which corresponds to the antinode of the primary vibration mode. When the viscoelastic body is to be mounted in the side portion 40, it is mounted in the part of the side portion 40, which corresponds to the antinode of the primary vibration mode.

If the viscoelastic body is large, the weight of the golf club head increases. Hence, the smaller the viscoelastic body, the more preferable. The viscoelastic body is preferably mounted such that its center is located in the part corresponding to the antinode of the primary vibration mode. In this embodiment, even when the viscoelastic body is small, if it is mounted in the part corresponding to the antinode of the primary vibration mode, it can suppress the vibration of the golf club head more effectively, thus satisfying both a weight reduction and vibration suppression of the golf club head. Regarding the size and shape of the viscoelastic body, for example, a circular disk-like viscoelastic body having a radius of about 15 mm and a thickness of about 1.5 mm can be used.

A method of specifying the part corresponding to the antinode of the primary vibration mode will be described. The part corresponding to the antinode of the primary vibration mode may be specified on the basis of the experimental value of a vibration mode test for a fabricated trial product of the golf club head A. However, since the test product must be fabricated, this method is cumbersome. Accordingly, it is convenient to specify (estimate) the part corresponding to the antinode of the primary vibration mode by subjecting a golf club head model to mode analysis by a computer. This method will be briefly described hereinafter.

Figure 2A:
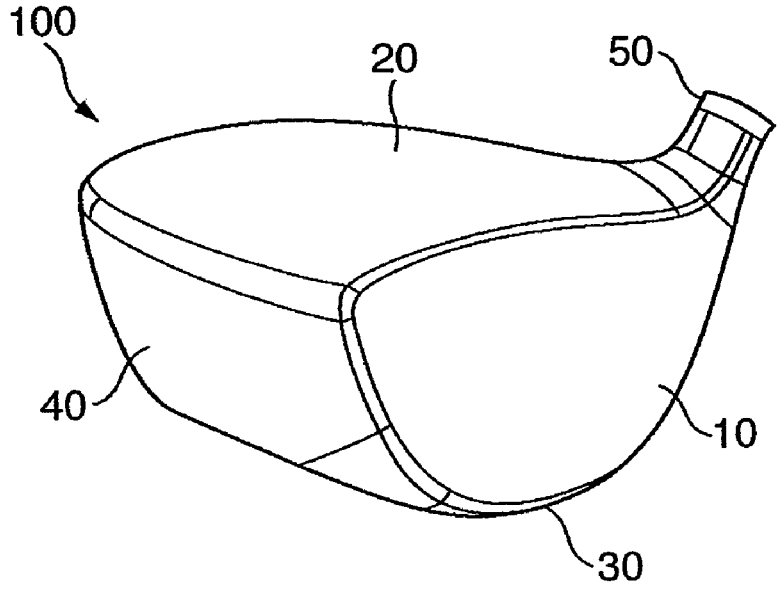
FIG. 2A is a view showing a three-dimensional model 100 of the golf club head A created by a computer.

First, a three-dimensional model of the golf club head A is created by the computer. The three-dimensional model can be created using CAD software by setting specifications such as the outer shape of the golf club head A, the wall thicknesses of the respective portions, the types (physical properties) of the materials, and the like. Naturally, this three-dimensional model does not include the viscoelastic bodies 51 and 52. FIG. 2A is a view showing a three-dimensional model 100 of the golf club head A created by the computer.

Figure 2B:
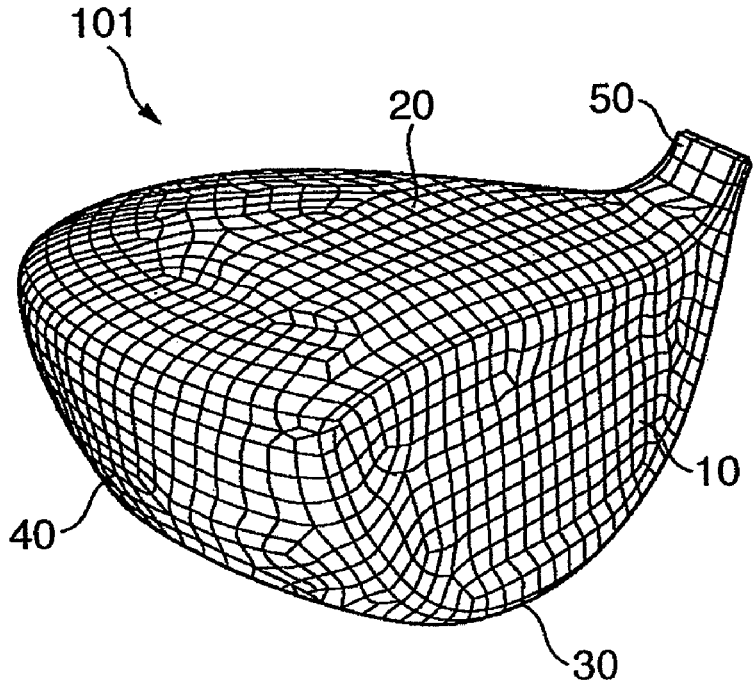
FIG. 2B is a view showing a three-dimensional mesh model 101 of the golf club head A created by the computer.

To analyze the three-dimensional model 100 by FEM (Finite Element Method), a mesh model of the three-dimensional model 100 is created by the computer using FEM software. FIG. 2B is a view showing a three-dimensional mesh model 101 of the golf club head A created by the computer. The respective elements that form the three-dimensional mesh model 101 are provided with the specifications of the corresponding portions.

Figure 3A:
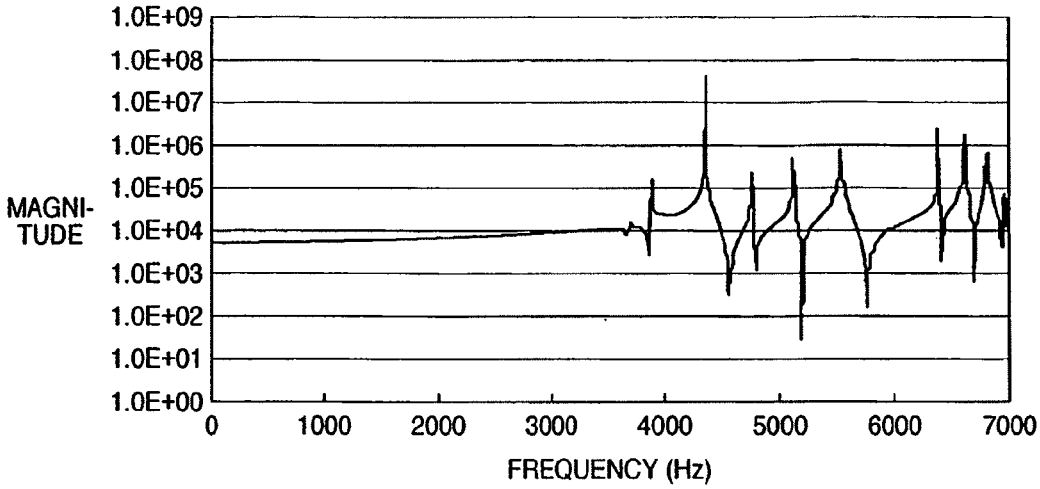
FIG. 3A is a graph showing an example of a frequency response function obtained by vibration mode analysis.

Subsequently, vibration mode analysis of the three-dimensional mesh model 101 is performed by the computer using analysis software. With the vibration mode analysis, first, the frequency response function of the golf club head A as a whole is obtained. FIG. 3A is a graph showing an example of a frequency response function obtained by the vibration mode analysis. In the example of FIG. 3A, several natural frequencies, including one near 3,900 Hz, can be confirmed. It is assumed that the respective primary vibration modes of the face portion 10, crown portion 20, sole portion 30, and side portion 40 occur at the natural frequencies of the golf club head A. Hence, the parts corresponding to the antinodes of the primary vibration modes of the respective portions are specified on the basis of the vibration modes in the vicinities of the respective natural frequencies.

Figure 3B:
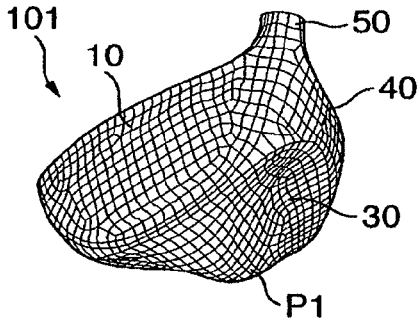
FIGS. 3B to 3D are views showing examples of vibration modes in the vicinities of a plurality of natural frequencies.
Figure 3C:
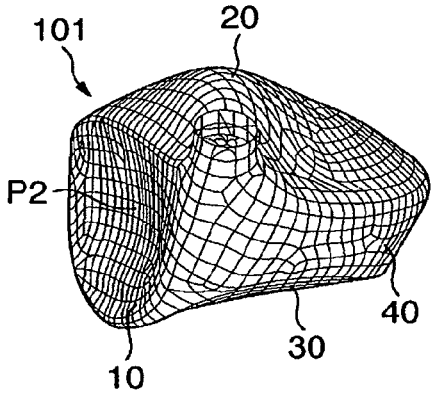
Figure 3D:
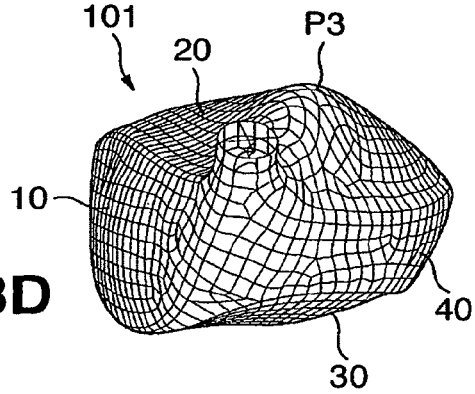

FIG. 3B to 3D are views showing examples of vibration modes in the vicinities of a plurality of natural frequencies, in which FIG. 3B is a 3,879-Hz vibration mode view, FIG. 3C is a 4,351-Hz vibration mode view, and FIG. 3D is a 4,760-Hz vibration mode view.

In the vibration mode view of FIG. 3B, the primary vibration mode occurs in the sole portion 30. The position (point P1) corresponding to the antinode of the primary vibration mode exists substantially at the center in the toe-to-heel direction and near the face in the face-to-back direction. In this case, as shown in FIGS. 1A and 1B, the viscoelastic body 52 is arranged substantially at the center in the toe-to-heel direction and near the face (near the face portion 10) in the face-to-back direction.

In the vibration mode view of FIG. 3C, the primary vibration mode occurs in the face portion 10. The position (point P2) corresponding to the antinode of the primary vibration mode exists substantially at the center both in the toe-to-heel direction and in the direction of height (the direction of the sole portion 30–crown portion 20). Therefore, when a viscoelastic body is to be mounted in the face portion 10, it is mounted substantially at the center both in the toe-to-heel direction and the direction of height.

In the vibration mode view of FIG. 3D, the primary vibration mode occurs in the crown portion 20. The position (point P3) corresponding to the antinode of the primary vibration mode exists near the heel in the toe-to-heel direction and near the back in the face-to-back direction. In this case, the viscoelastic body 51 is arranged near the heel in the toe-to-heel direction and near the back in the face-to-back direction, as shown in FIGS. 1A and 1B.

As many apparently widely different embodiments of the present invention can be made without departing from the spirit and scope thereof, it is to be understood that the invention is not limited to the specific embodiments thereof except as defined in the appended claims.

What is claimed is:

1. A method of identifying a position on a portion of golf club head having a face portion, a crown portion, a sole portion, and a side portion, corresponding to an antinode of a primary vibration mode of the golf club head, the method comprising:

creating, by a processor of a computer, a three-dimensional model of the golf club head;

obtaining the frequency response function of the golf club head as a whole;

confirming a natural frequency of the golf club head using the frequency response function;

identifying a portion of the golf club head from among the face portion, the crown portion, the sole portion, and the side portion on the basis of a vibration mode in the vicinity of the natural frequency; and identifying the position corresponding to the antinode of the primary vibration mode on the identified portion of the golf club head with reference to the vibration mode.

2. The method according to claim 1, wherein said obtaining comprises:

creating a mesh model of the three-dimensional model; and performing a vibration mode analysis of the mesh model for obtaining the frequency response function.

* * * * *